US006721546B1

(12) United States Patent
Compton

(10) Patent No.: US 6,721,546 B1
(45) Date of Patent: Apr. 13, 2004

(54) WIRELESS COMMUNICATION SYSTEM INCLUDING A UNIQUE DATA TRANSMISSION DEVICE

(75) Inventor: John I. Compton, Lexington, KY (US)

(73) Assignee: Point Six Wireless, LLC, Lexington, KY (US)

( * ) Notice: Subject to any disclaimer, the term of this patent is extended or adjusted under 35 U.S.C. 154(b) by 646 days.

(21) Appl. No.: 09/794,415

(22) Filed: Feb. 27, 2001

(51) Int. Cl.[7] ..... G08B 1/08

(52) U.S. Cl. ..... 455/91; 455/127.1; 455/517; 342/357.07; 340/10.2

(58) Field of Search ..... 455/91, 127.1, 455/127.5, 11.1, 12.1, 517, 456.1; 342/357.07, 457; 340/988, 992, 10.1, 10.2; 370/310.2, 311, 389, 391, 395.2

(56) References Cited

U.S. PATENT DOCUMENTS 5,588,005 A * 12/1996 Ali et al. ..... 370/346
5,686,888 A * 11/1997 Welles et al. ..... 340/539.13
6,181,260 B1 * 1/2001 Simon et al. ..... 340/949
6,295,449 B1 * 9/2001 Westerlage et al. ..... 455/422.1
6,463,272 B1 * 10/2002 Wallace et al. ..... 455/404.2
6,611,688 B1 * 8/2003 Raith ..... 340/992

* cited by examiner

*Primary Examiner*—Edward F. Urban
*Assistant Examiner*—Blane J. Jackson
(74) *Attorney, Agent, or Firm*—Frank C. Leach, Jr.

(57) ABSTRACT

A microprocessor, powered by a low cost battery, controls a wireless transmitter of a communication system. A sensor senses the value of at least one condition at a predetermined location. The transmitter transmits to a wireless receiver a data packet, which includes the value of the at least one condition, at randomly selected transmission time intervals. Closing of a multiple function push button switch activates an inactive microprocessor to cause its controlled transmitter to transmit irrespective of the selected transmission time interval until the next transmission if the switch is opened before a predetermined period of time elapses or to cause inactivation of the activated microprocessor for the longest available inactive period of time if the switch is held closed for the predetermined period of time.

46 Claims, 5 Drawing Sheets

WIRELESS COMMUNICATION SYSTEM INCLUDING A UNIQUE DATA TRANSMISSION DEVICE

This invention relates to a wireless communication system having one or more wireless transmitters transmitting data to one or more wireless receivers and, more particularly, to a wireless communication system in which a relatively low cost wireless transmitter transmits data to one or more wireless receivers without any communication from the wireless receiver.

Wireless transmitters have been used to transmit a condition such as temperature, humidity, temperature/humidity, or pressure, for example, from a predetermined location to a wireless receiver remote from the transmitter. These predetermined locations do not necessarily have any available power source other than a battery because they may be inside of a refrigerated space, a trailer, or an unmanned remote weather station, for example. The receivers usually have an electrical power source so that they do not have the problem of a battery as their only available power source.

Accordingly, various types of wireless communication systems have been suggested to provide power to the transmitter other than a battery. However, these have required a transceiver instead of only a transmitter at the remote location to receive a signal or sensing of the occurrence of an external event, for example, to cause transmission of data. That is, the power has been turned off in the previous transceivers until an external signal is received, but the previous transceivers have required a relatively significant amount of power to operate. This relatively significant amount of power results in a battery having a relatively short life for a relatively low cost battery or having to be a relatively expensive battery. Additionally, a transceiver increases the cost relative to a transmitter as does the event sensing hardware.

Furthermore, the transmission of signals from more than one wireless transmitter to a wireless receiver must be controlled to prevent collisions of the data packets from the different transmitters. If a collision occurs between two data packets from two different transmitters, the data is lost from both of the transmitters.

Various methods of avoiding collisions of the data packets from different transmitters have been suggested. These include using a different frequency for each transmitter or controlling activation of each of the transmitters from the receiver so that they are activated at different times. Each increases the cost.

There also have been suggestions of randomizing the time when the data is transmitted from each of the transmitters to avoid collisions of the data packets. However, randomization usually has been limited to the receiver controlling when the transmitter is activated.

Therefore, randomization has previously required a transceiver rather than only a transmitter. As previously mentioned, a transceiver increases the cost and also requires the utilization of additional power because of the transceiver being activated a relatively longer period of time than a transmitter and because of the additional hardware of a transceiver relative to a transmitter. As previously set forth, this reduces the life of the battery quicker or requires a more expensive battery to further increase the cost.

The present invention solves the foregoing problems by using a data transmission device to randomize the transmissions of data packets through creating a variable transmission time interval for each data transmission. This randomization is created solely at the transmitter.

The data transmission device of the present invention also reduces the transmission time interval for each data packet in comparison with presently available data transmission devices. This decreases the time that a battery is turned on to reduce the power used. This allows use of a low cost battery while extending the life of the low cost battery.

To utilize a low power and low cost battery for relatively long periods of time such as two to five years, for example, the circuitry of the data transmission device of the present invention must be inactivated most of the time. Of course, there is current leakage even when the transmitter and its controlling microprocessor are turned off. Therefore, even when the microprocessor is turned off so as to be in a low power "sleep" mode (inactivated), there is leakage, but it is very small so that this creates the low power "sleep" mode.

When the data transmission device of the present invention is shipped, it is important that the transmitter remain in a state in which it cannot transmit. This avoids reducing the life of the battery when the data transmission device of the present invention is not in use to power the microprocessor and the transmitter for transmission of data.

The transmitter could be activated by electrical noise during shipment. The microprocessor has software to prevent this inadvertent activation of the transmitter.

The data transmission device of the present invention is sealed in an enclosure. Thus, the battery cannot be manually disconnected during shipping; this is how previously available data transmission devices have prevented the transmitter from being turned on.

Accordingly, a multiple function push button switch is interfaced to the microprocessor, which controls transmission of the data packet by the transmitter. The push button switch provides activation and inactivation of the transmitter. The push button switch also enables testing of clock hardware settings and correction of them, if necessary, when the push button is manually depressed for a predetermined time period (103 milliseconds).

The microprocessor has software to enable the transmitter to respond to different periods of time that the multiple function push button switch is held in its closed position. The multiple function push button switch has four functions.

One of the four functions is to turn on the microprocessor. A second function is to inactivate the microprocessor for the longest available period of time by the multiple function push button switch being held in its closed position for the longest period of time (4 seconds).

A third function is to indicate to any receiver, which receives the transmitter's signals, that the microprocessor is being serviced by a human being through providing a service mark in the data packet transmitted when the multiple function push button switch is held in its closed position for at least 103 milliseconds but less than 4 seconds. This period of time insures that there is a transmission of a data packet.

A fourth function is to perform the initial reset after a battery is installed at the microprocessor. This fourth function avoids the need for conventional reset hardware since no reset is required by the circuitry of the data transmission device of the present invention. This is accomplished by configuring a clock, which is external of the microprocessor and provides a fixed periodic signal to awaken the microprocessor for a very short maximum period of time of 3 milliseconds, for example, every second.

The software in the microprocessor also insures that the transmitter will not be activated by electrical noise as could occur, for example, when the data transmission device of the present invention is being shipped since the microprocessor and the transmitter are powered on by pulse signals. Electrical noise can be interpreted as a pulse signal.

The data in the data packet is encoded in a form to reduce the transmission time of the data packet while increasing the transmission range of the transmitter. A shorter transmission time of each data packet decreases the possibility of collisions between data packets from two or more transmitters in the same environment.

An object of this invention is to provide a relatively low power wireless transmitter.

Another object of this invention is to provide random transmission of data packets by a wireless transmitter.

A further object of this invention is to provide a relatively low cost wireless transmitter.

Other objects of this invention will be readily perceived from the following description, claims, and drawings.

The attached drawings illustrate a preferred embodiment of the invention, in which.

Figure 1:
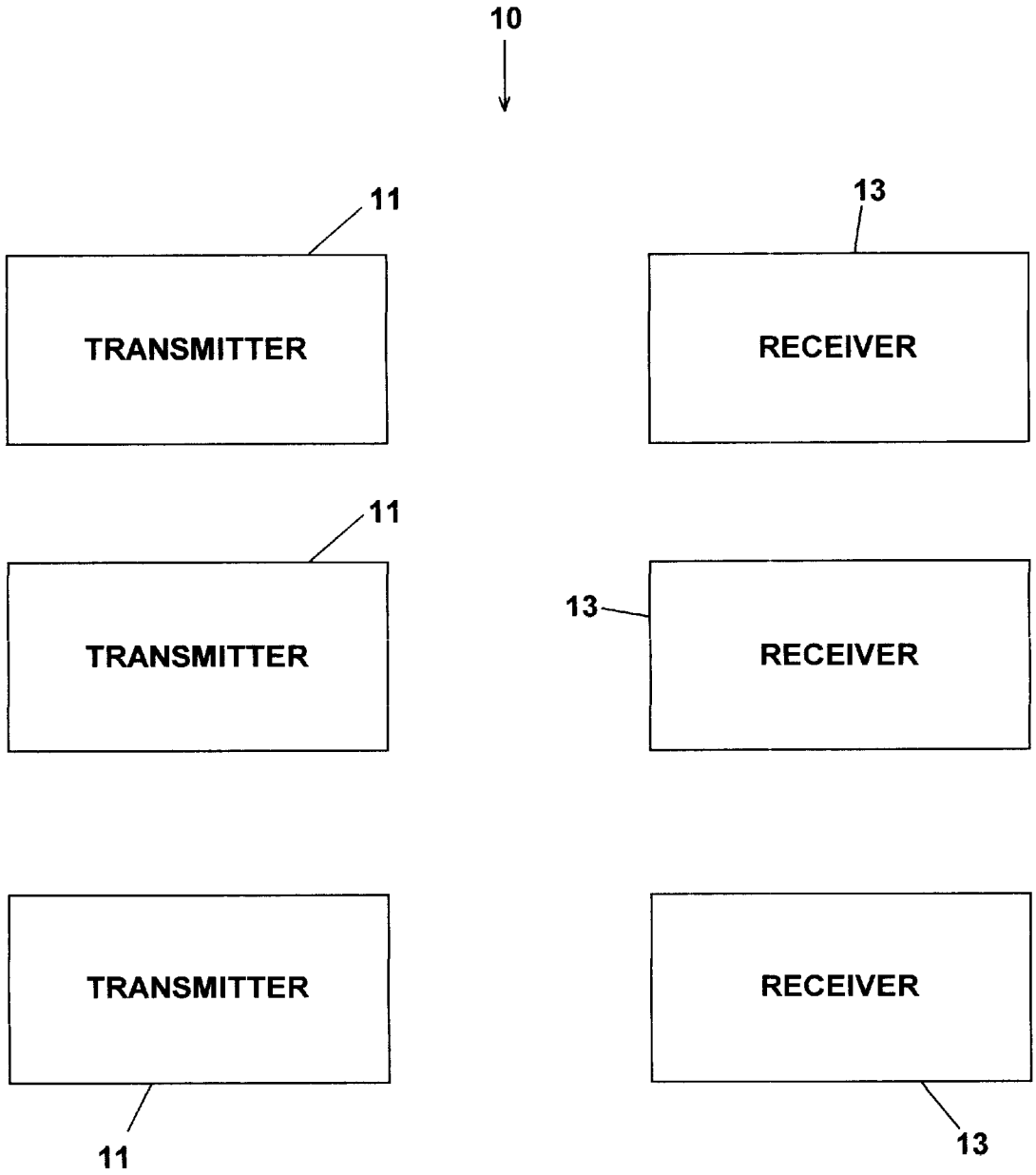
FIG. 1 is a block diagram of a wireless communication system having a plurality of transmitters of data transmission devices for transmitting data to a plurality of receivers.

Referring to the drawings and particularly FIG. 1, there is shown a wireless communication system 10 having a plurality of wireless transmitters 11 of data transmission devices 12 (see FIG. 2) and a plurality of wireless receivers 13 (see FIG. 1). One suitable example of the transmitter 11 is sold by Linx Technology, Inc., 575 S.E. Ashley Place, Grants Pass, Oreg. as model No. TXM-418-LC-R. One suitable example of the receiver 13 is sold by Linx Technologies, Inc. as model No. RXM-418-LC-R.

Each of the transmitters 11 can transmit data to each of the receivers 13. While a plurality of the receivers 13 has been shown, it should be understood that only one of the receivers 13 is necessary. Similarly, only one of the transmitters 11 is necessary irrespective of whether there is one or more than one of the receivers 13.

Each of the transmitters 11 is controlled by a microprocessor 14 (see FIG. 2) of the data transmission device 12. One suitable example of the microprocessor 14 is sold by Motorola as model No. MC68HC705KJ1.

Each of the microprocessors 14 is powered by a battery 15. One suitable of the battery 15 is a 3 volt lithium battery sold by Tadrian, U.S. Division, Port Washington, N.Y. as model No. TL5186. It has a 10 year shelf life.

The transmitter 11 is utilized to transmit at least one condition at a predetermined location. Examples of the conditions are pressure, temperature, humidity, and temperature/humidity. The description of the preferred embodiment will be given with temperature as the condition. Each of the other transmitters 11 could sense the temperature or another condition or conditions at other predetermined locations or another condition or conditions at the same predetermined location as the temperature is sensed.

A digital temperature sensor 16 is utilized to sense the temperature at the predetermined location. One suitable example of the digital temperature sensor 16 is a digital temperature sensor sold by Dallas Semiconductor, Inc., Dallas, Tex. as model No. DS18B20.

It should be understood that any other suitable digital temperature sensor or any suitable digitally interfaced analog temperature sensor may be employed, if desired. Furthermore, the type of sensor would vary in accordance with the condition being sensed.

The digital temperature sensor 16 is connected through a line 17 to an IN/OUT pin 18 of the microprocessor 14. Since the digital temperature sensor 16 is an open drain device, the battery 15 is connected through a resistor 19 to the line 17. This enables current to flow through the line 17 to either the digital temperature sensor 16 or the IN/OUT pin 18 of the microprocessor 14 depending on whether an internal switch (not shown) in the digital temperature sensor 16 or an internal switch (not shown) in the microprocessor 14 connects the line 17 to ground.

Figure 2:
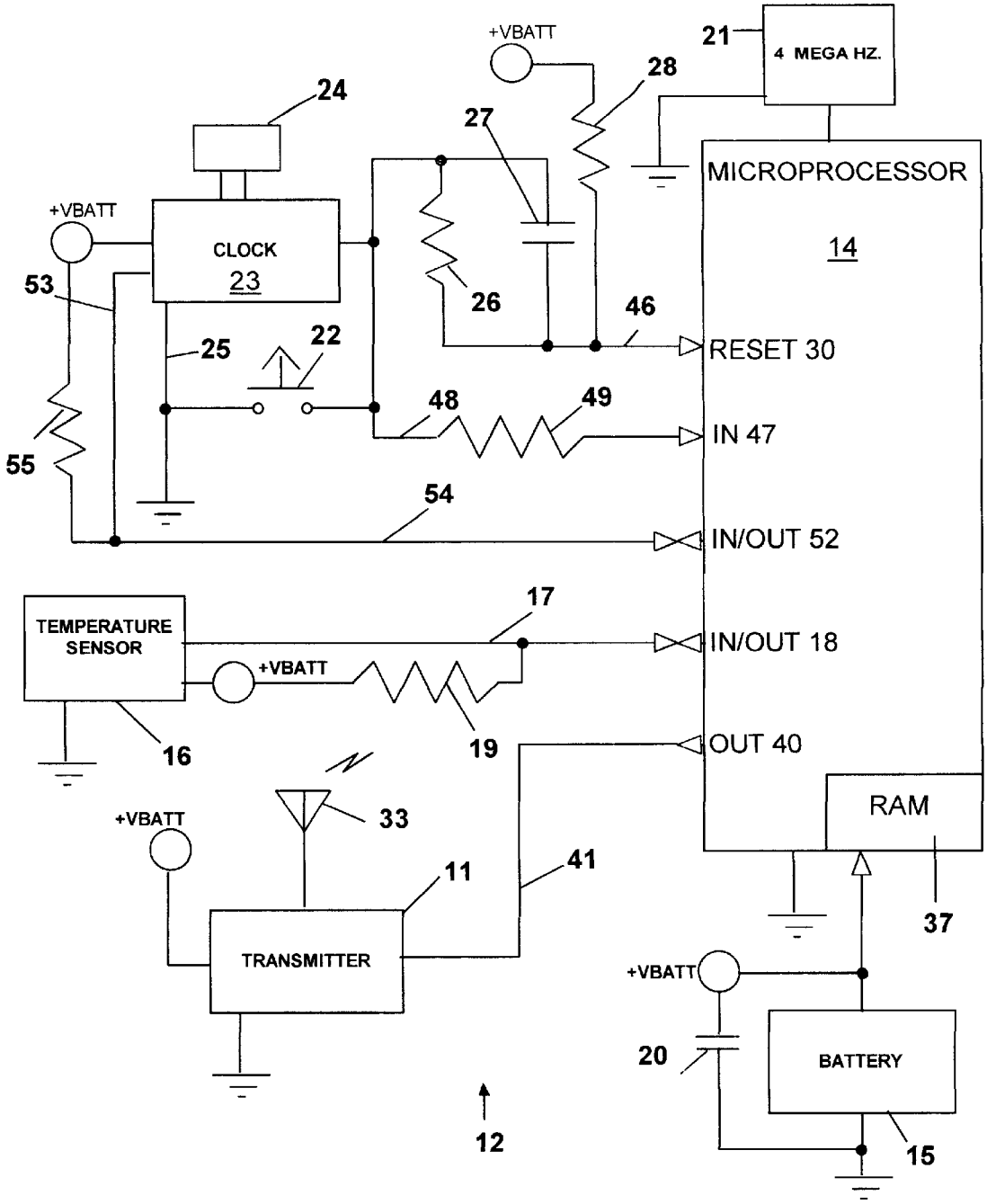
FIG. 2 is a schematic circuit diagram of a data transmission device of the present invention including a transmitter, its controlling microprocessor, a sensor, and a power source.

The circuit of FIG. 2 requires short time peak currents as high as 5 milliamps. The battery 15 may not be capable of supplying these short time peak currents.

Accordingly, to supply the peak currents required for the relatively short time periods in which the microprocessor 14 and the transmitter 11 are consuming energy during a transmission, a capacitor 20 is utilized. The capacitor 20 has a relatively large capacitance such as 100 microfarads, for example, to supply the peak current of 5 milliamps, for example.

A ceramic resonator 21, which is part of an oscillator of the microprocessor 14, is connected to the oscillator in the microprocessor 14 to control its frequency. The oscillator operates at a frequency of 4 MHz, and the microprocessor 14 operates at a frequency of 2 MHz. It should be understood that a crystal, which is more expensive than the ceramic resonator 21, could be employed, if desired.

As long as a push button 22, which is a normally open momentarily closed contact switch, is in its open position as shown in FIG. 2, the microprocessor 14 is reset every one second under the control of a clock 23. The clock 23 has a quartz crystal 24 connected thereto.

The quartz crystal 24 operates at a frequency of 32,768 cycles per second. The clock 23 divides the frequency of the quartz crystal 24 to one cycle per second. It should be understood that the clock 23 can produce some other frequencies or a different clock with other frequencies may be employed.

When a first internal switch (not shown) within the clock 23, which is an open drain device, is closed to connect the clock 23 to ground through a line 25 and to the positive voltage of the battery 15 through a resistor 26 and a capacitor 27 in parallel and a resistor 28, current flows through the resistor 28 and charges the capacitor 27 to create a pulse at a RESET pin 30 of the microprocessor 14.

The first internal switch in the clock 23 is closed for only 120 microseconds. Each closing of the first internal switch in the clock 23 when the push button 22 is in its open position results in the microprocessor 14 being awakened (activated). This is shown at steps 31 and 32 of the flow chart of FIG. 3.

One suitable example of the clock 23 (see FIG. 2) is a 1-Wire clock sold by Dallas Semiconductor, Inc. as model No. DS2417. This 1-Wire clock has a unique serial number.

The unique serial number of the clock 23 can be adopted as the serial number of the transmitter 11 for use in the transmitted data packet if the digital temperature sensor 16 is other than the digital temperature sensor sold by Dallas Semiconductor as model No. DS18B20. The Dallas Semiconductor model No. DS18B20 digital temperature sensor has a unique serial number too. This serial number, which has a unique 64-bit format, is utilized in each data packet transmitted by the transmitter 11 through an antenna 33. One suitable example of the antenna 33 is a quarter wave copper wire that is looped inside a lid of an enclosure of the data transmission device 12.

Figure 3:
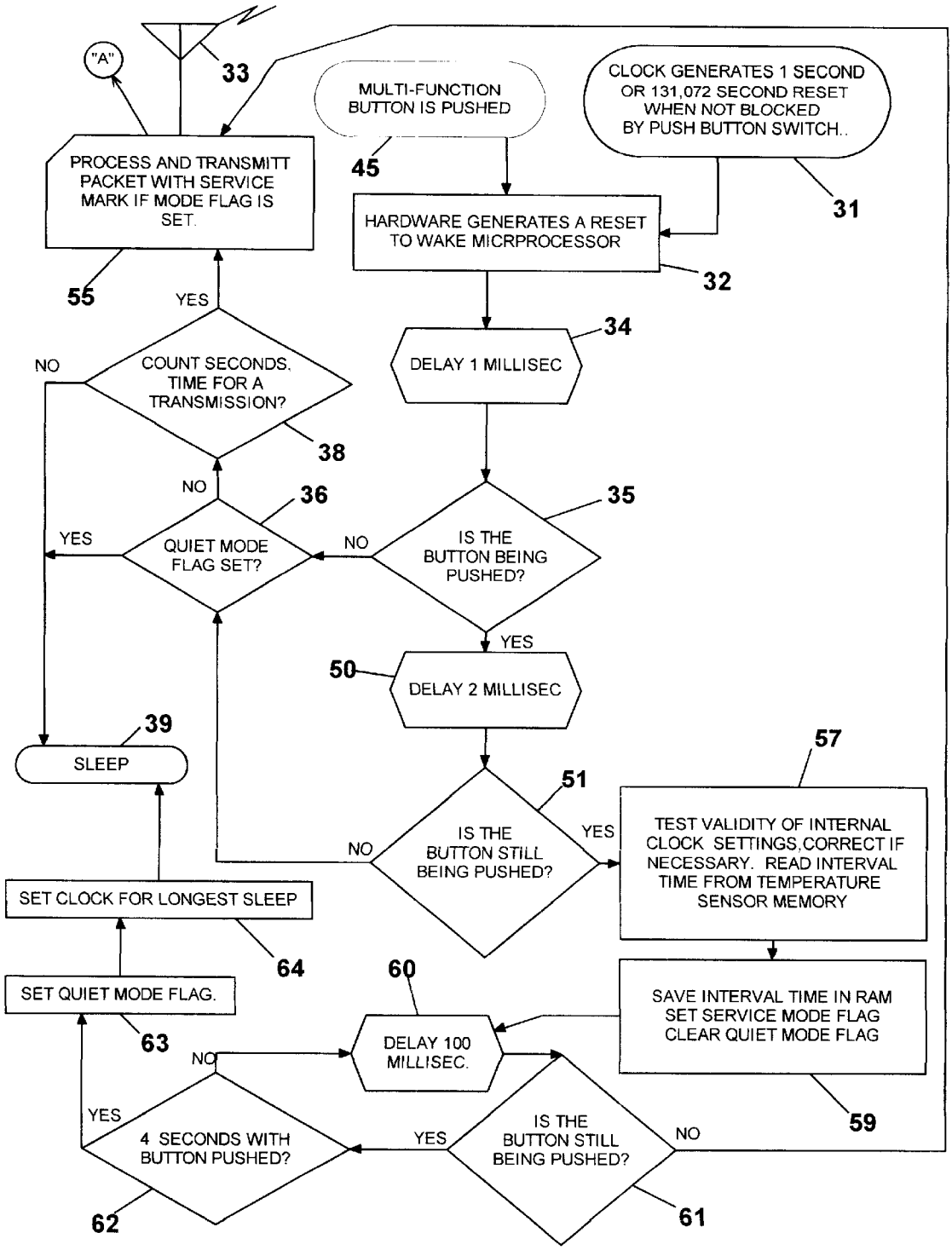
FIG. 3 is a flow chart disclosing an algorithm of how multiple functions of the circuit of FIG. 2 are controlled by a manually activated push button.

Each of the pulse signals from the clock 23 to the RESET pin 30 wakes up (activates) the microprocessor 14 as indicated at the step 32 in FIG. 3. After a delay of 1 millisecond as shown at step 34 in FIG. 3, a determination is made by the software in the microprocessor 14 (see FIG. 2) at step 35 (see FIG. 3) to determine if the push button 22 (see FIG. 2) is in its closed position due to the push button 22 being depressed.

The delay of 1 millisecond prevents inadvertent transmission by the transmitter 11 (see FIG. 2) due to electrical noise. This is particularly pertinent when the data transmission device 12 is being shipped. Electrical noise causing transmissions by the transmitter 11 could significantly shorten the life of the battery 15.

With the push button 22 not in its closed position, a step 36 (see FIG. 3) shows that software in the microprocessor 14 (see FIG. 2) determines if a quiet mode flag is set. Since the transmitter 11 was activated to transmit a data packet, the quiet mode flag is not set.

Accordingly, software in the microprocessor 14 causes an internal RAM 37 in the microprocessor 14 to be incremented by a count of one. Thus, the RAM 37 may be deemed to be a counter, which counts each activation of the microprocessor 14. If the count in the RAM 37 has not reached the necessary count for the next transmission of a data packet by the transmitter 11 as indicated at step 38 in FIG. 3, then the microprocessor 14 (see FIG. 2) is turned off (sleep) as shown at step 39 in FIG. 3.

If the calculated time from the last transmission to the next transmission of the data packet has elapsed, then a signal would have been sent from an OUT pin 40 (see FIG. 2) of the microprocessor 14 over a line 41 to the transmitter 11. The transmitter 11 cannot send signals over the line 41 to the microprocessor 14.

In initially activating (waking up) the microprocessor 14, the push button 22 must be moved to its closed position. This is shown at step 45 (see FIG. 3).

When the push button 22 (see FIG. 2) is held in its closed position, this causes a line 46, which is connected to the RESET pin 30 of the microprocessor 14, to be driven low for the short time required to charge the capacitor 27 through the resistor 28. After this short period of time to charge the capacitor 27, the voltage at the RESET pin 30 of the microprocessor 14 rises to a level that allows the microprocessor 14 to operate.

The state (open or closed position) of the push button 22 is read on an IN pin 47 of the microprocessor 14 by software in the microprocessor 14. The IN pin 47 is connected to a line 48 having a resistor 49 therein. If there is a software malfunction, the resistor 49 limits the current flow so that the voltage level on the line 48 cannot drive the signal at the IN pin 47.

The state of the push button 22 is initially read on the IN pin 47 after the delay of 1 millisecond as shown at the step 34 in FIG. 3 and again after the delay of 2 milliseconds at a step 50. If the push button 22 is still being pushed after the delay of 1 millisecond as indicated by the voltage level at the IN pin 47 (see FIG. 2), the voltage level at the IN pin 47 is again read by the microprocessor 14 after the delay of 2 milliseconds as shown at the step 50 in FIG. 3.

After the delay of 2 milliseconds, a determination is again made by the software in the microprocessor 14 (see FIG. 2) in accordance with the signal at the IN pin 47 as to whether the push button 22 is still being pushed (i.e., in its closed position). This is disclosed at step 51 in FIG. 3.

If the correct voltage level is not at the IN pin 47 (see FIG. 2) to indicate that the push button 22 is in its closed position, the software in the microprocessor 14 will again determine if the quiet mode flag is set as shown at the step 36 in FIG. 3. Since the quiet mode flag is set only if the transmitter 11 (see FIG. 2) is not activated to transmit due to a signal from the microprocessor 14 on the line 41, the software in the microprocessor 14 again inactivates the microprocessor 14, as indicated at the step 39 in FIG. 3, if it has been awakened by electrical noise rather than by the push button 22 (see FIG. 2) being in its closed position.

If the push button 22 is still being pushed, the voltage level at the IN pin 47 would indicate that a good signal is being received. This is because of the push button 22 being in its closed position rather than noise activating the microprocessor 14 after the delay of 2 milliseconds.

With the microprocessor 14 receiving a valid push button signal at the IN pin 47 that the push button 22 is depressed the microprocessor 14 runs validity tests on the hardware of the clock 23. This eliminates the need for conventional reset hardware to reduce the cost.

The clock 23, which is an open drain device, communicates with an IN/OUT pin 52 of the microprocessor 14 through lines 53 and 54. The current flows from the battery 15 through a resistor 55 and the line 54 to the IN/OUT pin 52 of the microprocessor 14 or through the line 54 to the clock 23 depending on whether a second internal switch (not shown) in the clock 23 or an internal switch in the microprocessor 14 is grounded. The line 54 is used by the microprocessor 14 to check diagnostics of the hardware of the clock 23. This is shown at step 57 in FIG. 3.

After making any necessary corrections to the hardware settings in the clock 23 (see FIG. 2), a service mode flag is set, and the quiet mode flag is cleared as indicated at step 59 in FIG. 3. This is because pushing of the push button 22 (see FIG. 2), as shown at step 51 in FIG. 3, indicates that the push button 22 (see FIG. 2) is being manually pushed by a human being so that the transmission data device 12 is in its service mode.

After a delay of 100 milliseconds as indicated at step 60 (see FIG. 3), the microprocessor 14 (see FIG. 2) again determines the voltage level at the IN pin 47. If the voltage level at the IN pin 47 has changed because of the push button 22 being released, the transmitter 11 is activated with the service mark flag set.

Thus, the depression of the push button 22 (see FIG. 2) to its closed position and its release causes transmission of a data packet by the transmitter 11 even if the selected time interval from the last transmission has not elapsed. This is shown at step 61 in FIG. 3.

It should be understood that pulse signals to the RESET pin 30 (see FIG. 2) are not generated by the clock 23 when the push button 22 is in its closed position. This is because the push button 22 is holding the clock 23 grounded.

If the push button 22 continues to be depressed for four seconds as shown at step 62 in FIG. 3 following determination after each increment of 100 milliseconds that the push button 22 is still depressed, the quiet mode flag is set as disclosed at step 63. This quiet mode flag is set in the RAM memory 37 (see FIG. 2) of the microprocessor 14.

After the quiet mode flag has been set, the microprocessor 14 sets the clock 23 for the longest sleep as indicated at step 64 in FIG. 3. The longest time that the clock 23 (see FIG. 2) can be set is 131,072 seconds. This is slightly greater than 1½ days. Therefore, the clock 23 (see FIG. 2) cannot awaken (activate) the microprocessor 14 for 1½ days unless the push button 22 is depressed.

This would be particularly useful when the data transmission device 12 is being shipped. This is because the push button 22 cannot be accidentally moved to its closed position. Accordingly, the push button 22 is capable of activating the microprocessor 14 when it is in its inactive state (sleeping) as its first function or inactivating the microprocessor 14 when it is in its activated (awake) state as its second function.

A third function of the push button 22 is to identify to each of the receivers 13 (see FIG. 1) that the specific microprocessor 14 (see FIG. 2) is being serviced by a human being. This is accomplished by the transmitted data packet having a service mode mark set therein due to the set service mode flag being set by the push button 22 being pushed as indicated at the steps 51 and 59 in FIG. 3.

A fourth function of the push button 22 (see FIG. 2) is to perform the initial reset of the microprocessor 14 after installation of the battery 15 and to configure the hardware of the clock 23 for proper operation. This eliminates the need for conventional reset hardware.

Figure 4:
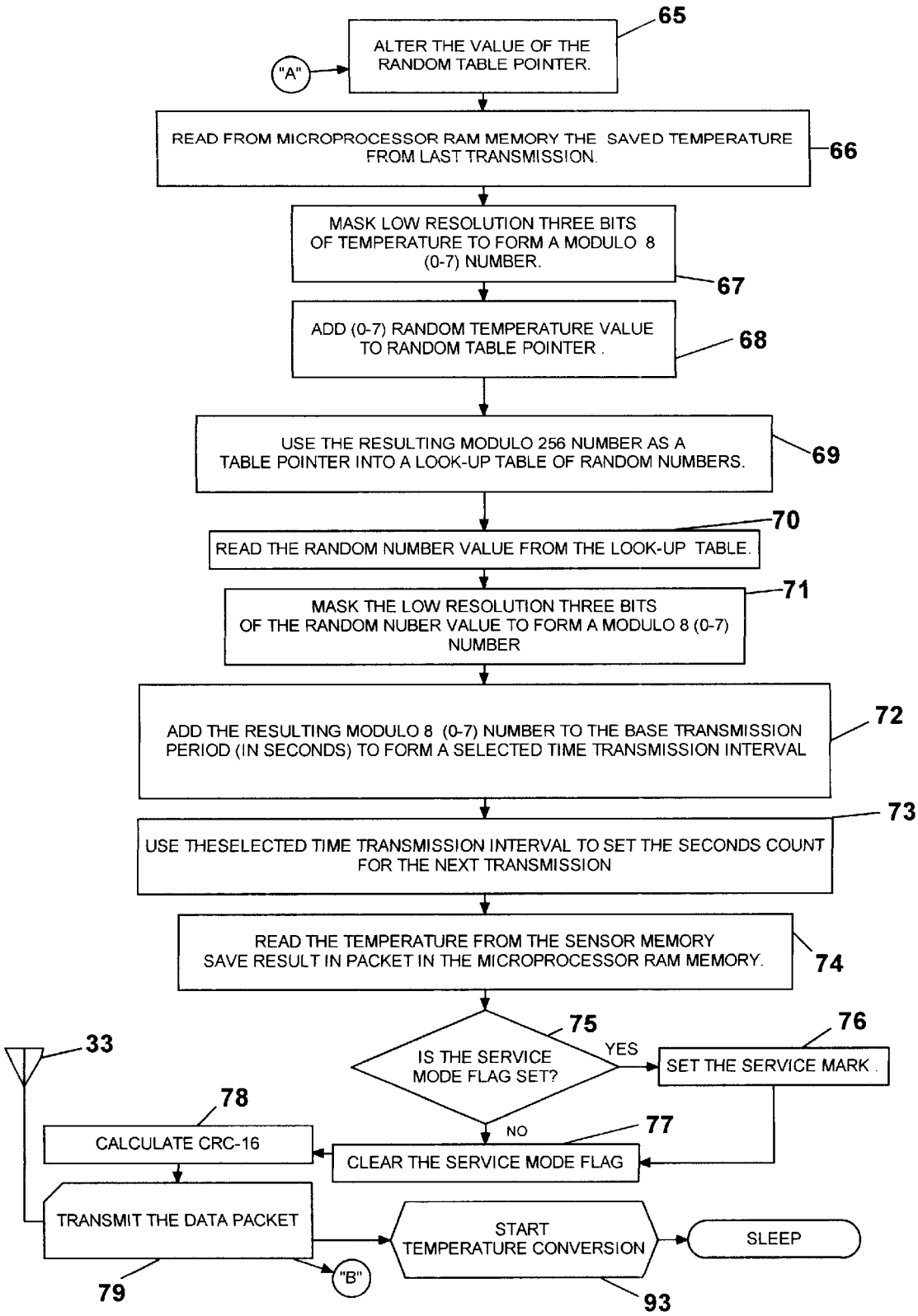
FIG. 4 is a flow chart showing an algorithm for processing and randomly transmitting a data packet by the transmitter of FIG. 2.

To insure that each of the transmitters 11 randomly transmits the data packets, the flow chart in FIG. 4 discloses how the random times between transmissions are controlled by software in the microprocessor 14 (see FIG. 2). Point A is shown as connecting FIGS. 3 and 4. The same steps are employed irrespective of whether the transmission is produced by depressing the push button 22 (see FIG. 2) or by the clock 23 generating a predetermined number of pulses to the RESET pin 30 of the microprocessor 14.

The RAM 37 has the value of a random table pointer, which is an 8-bit number, stored therein and incremented by a count of one at the start of each calculation. This is disclosed at step 65 in FIG. 4. This variable number is used in determining the selected transmission time interval between transmissions of data packets by the transmitter 11. It should be understood that the value of the random table pointer may be stored in a memory other than in the microprocessor 14 (see FIG. 2), if desired.

The temperature read by the digital temperature sensor 16 after the end of the last transmission of a data packet is read from the RAM 37 in the microprocessor 14 where it has been stored from an internal memory in the digital temperature sensor 16. This is indicated at step 66 in FIG. 4. It should be understood that the temperature read from the RAM 37 (see FIG. 2) in the microprocessor 14 may be other than the temperature read by the digital temperature sensor 16 after the end of the last transmission of a data packet, if desired.

Next, the software in the microprocessor 14 (see FIG. 2) masks the low resolution three bits (least significant three bits) of the value of the temperature in the RAM 37 to form a modulo 8 (0–7) number. This is shown at step 67 in FIG. 4. These are the three bits having the most change as the temperature changes in 0.5° C. increments.

It should be understood that the digital temperature sensor 16 (see FIG. 2) is adjustable for a plurality of desired temperature increments. It also should be understood that other than the least significant three bits of the value of the temperature may be masked, if desired.

The value of the modulo 8 number in the RAM 37 of the microprocessor 14 is added to the value of the random table pointer stored in the RAM 37 of the microprocessor 14 to produce a modulo 256 (0–255) number. This is shown at step 68 in FIG. 4.

Instead of adding the value of the modulo 8 number in the RAM 37 of the microprocessor 14 to the value of the random table pointer to produce the modulo 256 (0–255) number, the modulo 256 (0–255) number may be obtained in other ways. Examples are by exclusive or logic of these two values or shifting the value of the random table pointer in accordance with the value of the modulo 8 number.

The value of the modulo 256 number is employed as a table pointer in a look-up table of random numbers as disclosed at step 69. The value of the random number from the look-up table is read as indicated at step 70.

The low resolution three bits (least significant three bits) of the value of the random number from the look-up table is masked to form a modulo 8 number as disclosed at step 71. The value of this resulting modulo 8 number is added to a base transmission period in seconds to form a pseudo random number in seconds as shown at step 72.

The base transmission period in the preferred embodiment is 56 seconds. The transmission period, which is the selected time interval between transmissions, varies from 56 to 63 seconds but averages 59.5 seconds over a relatively long period of time. Thus, a value from 0–7 as the resulting modulo 8 number is added to 56 to produce a selected time interval between transmissions varying between 56 and 63 seconds.

The transmission time interval is saved in the RAM 37 (see FIG. 2) of the microprocessor 14 for the next transmission by the transmitter 11. This is disclosed at step 73 of FIG. 4.

The digital temperature sensor 16 (see FIG. 2) is again read by the microprocessor 14. This value of the temperature is saved for use in the data packet to be transmitted. This is shown at step 74 in FIG. 4.

The microprocessor 14 (see FIG. 2) then inquires as to whether the service mode flag in the RAM 37 was set at the step 59 in FIG. 3. This is found at step 75 in FIG. 4.

If the service mode flag is set, then the service mark is set in the RAM 37 (see FIG. 2) of the microprocessor 14 as shown at step 76 in FIG. 4. The microprocessor 14 (see FIG. 2) sets the service mark in the data packet that is to be sent in the next transmission by the transmitter 11. AS previously mentioned, this informs each of the receivers 13 (see FIG. 1) that a human being is at the specific transmitter 11.

Then, the service mode flag is cleared as indicated at step 77 in FIG. 4 irrespective of whether it was set. That is, if it was not set, the clearing of the service flag step would still occur in the software of the microprocessor 14 (see FIG. 2).

Next, the microprocessor 14 calculates the CRC-16 value as shown at step 78 in FIG. 4. The microprocessor 14 (see FIG. 2) places the CRC-16 value in the data packet. The data packet is transmitted by the transmitter 11 after the calculation of the CRC-16 value as indicated at step 79 in FIG. 4.

Figure 5:
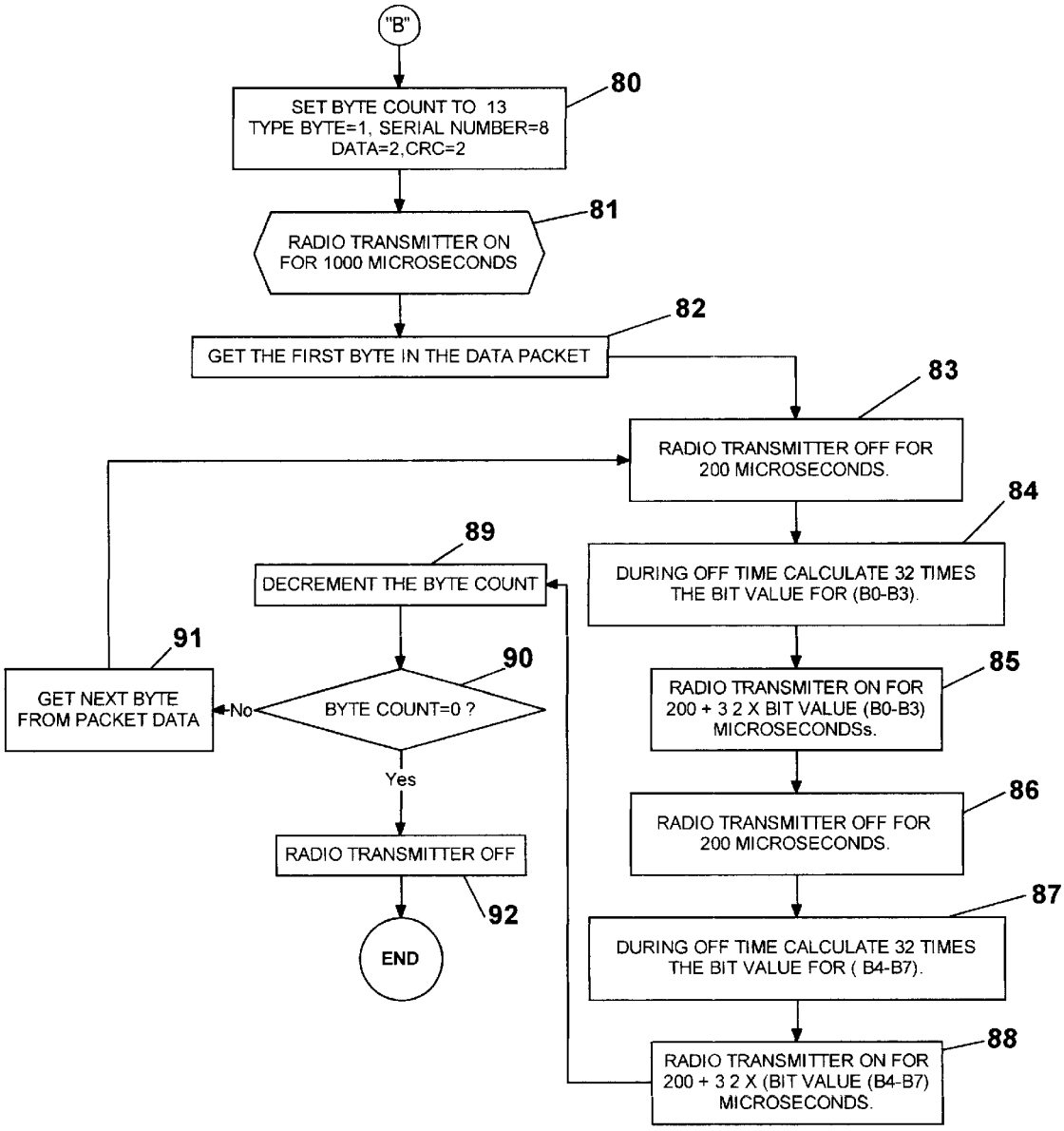
FIG. 5 is a flow chart illustrating an algorithm for transmission of a data packet by the transmitter of FIG. 2.

The flow chart of FIG. 5 discloses how a data packet is transmitted. Point B is disclosed as connecting FIGS. 4 and 5. The transmitted data packet has 13 bytes with the bytes divided into four portions as follows: [type] [serial no] [data] [CRC-16].

One byte of the data packet identifies the [type] of transmitter generating the data packet. For example, a first binary number in the transmitted data packet indicates a temperature value being sent when the push button 22 (see FIG. 2) is in its open position while a second binary number represents the transmission of the temperature value when the push button 22 is in its closed position. Two other binary numbers would be used if relative humidity/temperature values, for example, were being transmitted rather than only the temperature value with one of the two binary numbers representing the push button 22 in its closed position and the other indicating that the push button 22 is in its open position.

The [serial number] portion of the data packet comprises eight bytes obtained from the digital temperature sensor 16 sold by Dallas Semiconductor as model No. DS18B20, for example. Each of the Dallas Semiconductor digital temperature sensors constituting the digital temperature sensor 16 and the Dallas Semiconductor 1-Wire clock, which is the clock 23, has a unique serial number as previously discussed. It is a guaranteed unique 64-bit pattern which cannot be changed.

As previously mentioned, the serial number of the digital temperature sensor 16 sold by Dallas Semiconductor, Inc. as model No. DS18B20 provides the serial number of the data packet transmitted by the transmitter 11. The serial number portion of the 13-byte data packet constitutes eight bytes since it is a unique 64-bit pattern.

The data portion of the 13-byte data packet constitutes two bytes. The final two bytes of the 13-byte data packet are the error validation of the data packet in the classic CRC-16 format.

Accordingly, as shown at step 80 in FIG. 5, the byte count is set at 13 in the microprocessor 14 (see FIG. 2) with type=1, serial number=8, data=2, and CRC=2. This occurs when the microprocessor 14 sends a signal over the line 41 via the OUTPUT pin 40 to the transmitter 11 to transmit the data packet, which also is sent over the line 41 through the OUT pin 40.

The microprocessor 14 next turns on the transmitter 11 for 1,000 microseconds by sending a signal over the line 41 to the transmitter 11 as disclosed at step 81 in FIG. 5. This period of time enables each of the receivers 13 (see FIG. 1) to start and allows the automatic gain controls in the front end of each of the receivers 13 to adjust to the strength of the received signal before data is transmitted by the transmitter 11 (see FIG. 2).

The microprocessor 14 then obtains the first byte in the data packet from the RAM 37 in the microprocessor 14 as indicated at step 82 in FIG. 5 and causes the transmitter 11 (see FIG. 2) to be turned off for 200 microseconds through sending a signal over the line 41 to the transmitter 11 as shown at step 83 in FIG. 5. During the off time of the transmitter 11 (see FIG. 2) for 200 microseconds, the microprocessor 14 calculates the value of the product (32 (bit value (B0–B3)) for half of the first byte as shown at step 84 in FIG. 5. This is the encoding of the first four bits of the first byte of the data packet so that four bits are transmitted per cycle.

While it is preferred to use four bits per cycle, it is not necessary for the transmitter 11 (see FIG. 2) to transmit the data packet. Encoding of 3, 4, or 5 bits per cycle is disclosed in U.S. Pat. No. 4,357,634 to Chung, for example.

Next, the transmitter 11 is turned on for a period of time equal to the calculated value of (200+32 (bit value (B0–B3)) microseconds as indicated at step 85 in FIG. 5. After this transmission, the transmitter 11 (see FIG. 2) is again turned off for 200 microseconds as disclosed at step 86 in FIG. 5. During the off time, there is a calculation of the value of the product (32 (bit value (B4–B7)) as disclosed at step 87 in FIG. 5. This is the second four bits of the first byte.

As indicated at step 88, the transmitter 11 (see FIG. 2) is turned on for a period of time equal to the calculated value of (32 (bit value (B4–B7)). When this transmission is completed, one byte of the data packet has been transmitted, and the byte count in the RAM 37 (see FIG. 2) in the microprocessor 14 is decremented by one as indicated at step 89 in FIG. 5.

Next, it is determined if the byte count in the RAM 37 (see FIG. 2) in the microprocessor 14 is equal to 0 as disclosed at step 90 in FIG. 5. If the byte count is not equal to 0, the next byte is obtained from the data packet as shown at step 91. When there is another byte, the steps 83–90 are again performed by the software in the microprocessor 14 (see FIG. 2). When the byte count=0 at the step 90 in FIG. 5, the transmitter 11 (see FIG. 2) is turned off as disclosed at step 92 in FIG. 5.

After the transmitter 11 (see FIG. 2) is turned off by the microprocessor 14, the microprocessor 14 sends a signal to the digital temperature sensor 16 from the IN/OUT pin 18 over the line 17 to start another temperature conversion in the digital temperature sensor 16. The microprocessor 14 then goes to sleep (inactivated) automatically from its software.

When the digital temperature sensor 16 is the digital temperature sensor sold by Dallas Semiconductor as model DS18B20, it requires 93 milliseconds to convert the temperature read by the digital temperature sensor 16. Upon completion of the temperature conversion period, the digital temperature sensor 16 is automatically inactivated when it is the digital temperature sensor sold by Dallas Semiconductor as model DS18B20. However, the digital temperature sensor 16 maintains the reading of the temperature in its internal RAM so that it can be read at the start of the next cycle by the microprocessor 14.

A substantial saving in energy is obtained by turning off all of the electronics except for the digital temperature sensor 16 as soon as the temperature conversion starts. Accordingly, only the digital temperature sensor 16 is using power during the relatively long temperature conversion period of 93 milliseconds.

As shown at the step 60 in FIG. 3, there is a minimum delay of 103 milliseconds before there can be a transmittal of a data packet when the push button 22 (see FIG. 2) is pushed. This is greater than the 93 milliseconds for the digital temperature sensor 16 to read the temperature, convert it, and store the conversion in its internal RAM.

It should be understood that other digital temperature sensors are capable of enabling the microprocessor 14 to turn off after the microprocessor 14 sends the signal to the digital temperature sensor 16 to start another conversion of the temperature. However, the temperature time conversion period may be different.

It should be understood that other than the modulo 8 numbers may be used to determine the random number in the look-up table in the microprocessor 14. It also should be understood that other than the three least significant bits may be masked in forming any of the modulo 8 numbers.

It is only necessary that a portion of the numbers be used to form the modulo 8 numbers. Thus, each of the modulo 8 numbers does not have to be formed by the same three bits. That is, one can be formed by the three least significant bits and another formed by the three most significant bits, for example.

It should be understood that the look-up table in the microprocessor 14 has only modulo 8 (0–7) numbers as its output or selected numbers while its inputs numbers can be any of the modulo 256 (0–255) numbers. Furthermore, the modulo 8 numbers are not necessarily equal in the output or selected numbers of the look-up table in the microprocessor 14.

An advantage of this invention is that a transmitter, which is controlled by a microprocessor, is powered by a long life battery having a relatively low cost.

Another advantage of this invention is that it prevents synchronous collisions of data packets transmitted from more than one transmitter.

A further advantage of this invention is that it minimizes collisions of data packets transmitted from more than one transmitter.

Still another advantage of this invention is that it prevents synchronization of the data packets transmitted from different transmitters.

A still further advantage of this invention is that it only requires a single push button switch for manual control of multiple functions of the data transmission device.

Yet another advantage of this invention is that it prevents electrical noise from causing activation of the microprocessor controlling the transmitter without any action by a shipper.

A yet further advantage of this invention is that the push button and the circuitry of the data transmission device may be encompassed in a sealed enclosure and still have no activation of the microprocessor by electrical noise.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A method of randomly transmitting data packets to at least one wireless receiver from a wireless transmitter controlled by a microprocessor powered by a battery including:

sensing a value of at least one condition at a predetermined location;

transmitting a data packet having the value of the at least one condition at the predetermined location at varying selected transmission time intervals with only one data packet transmitted during each selected transmission time interval;

using the value of a stored variable number and at least a portion of the value of the at least one condition at the predetermined location at a predetermined time relative to each transmission to provide a random number value for use in determining the selected transmission time interval from the last transmission until a data packet having the value of the at least one condition at the predetermined location is next to be transmitted by the transmitter;

changing the value of the stored variable number after each transmission;

using the changed value of the stored variable number and at least a portion of the value of the at least one condition at the predetermined location at the predetermined time relative to each transmission to change the random number value after each transmission of a data packet by the transmitter;

and using the changed random number value in determining the selected transmission time interval until the next transmission of a data packet by the transmitter.

2. The method according to claim 1 including:

automatically activating the microprocessor at a predetermined fixed time interval;

and automatically inactivating the microprocessor a predetermined time period after each activation unless the selected transmission time interval from the last transmission has elapsed.

3. The method according to claim 2 including providing each data packet with the same identification number.

4. The method according to claim 3 including automatically activating the microprocessor at each of the predetermined fixed time intervals by a timing device external of the microprocessor.

5. The method according to claim 4 including manually selectively activating the microprocessor at any time.

6. The method according to claim 5 including:

storing the variable number in the microprocessor;

and using the sum of the changed value of the variable number after each transmission and at least a portion of the sensed value of the at least one condition at the predetermined location at the predetermined time relative to each transmission to obtain the value of the random number from a look-up table in the microprocessor for use in determining the selected transmission time interval until the next transmission of a data packet.

7. The method according to claim 6 including changing the value of the at least one condition at the predetermined location to be transmitted each time that its value changes a predetermined amount between transmissions.

8. The method according to claim 5 including:

manually activating the microprocessor by closing a manually movable switch;

and utilizing the time that the manually movable switch is closed to determine whether the microprocessor causes activation of the transmitter irrespective of whether the selected transmission time interval has elapsed or causes inactivation of the microprocessor for the longest available period of time when the manually movable switch remains closed for a predetermined period of time without the microprocessor activating the transmitter.

9. The method according to claim 5 including:

storing the variable number in the microprocessor;

and using the sum of the changed value of the variable number after each transmission and the three least significant bits of the sensed value of the at least one condition at the predetermined location at the predetermined time relative to each transmission to obtain the value of the random number from a look-up table in the microprocessor for use in determining the selected transmission time interval until the next transmission of a data packet.

10. The method according to claim 1 including:

storing the variable number in the microprocessor;

and using the sum of the changed value of the variable number after each transmission and at least a portion of the sensed value of the at least one condition at the predetermined location at the predetermined time relative to each transmission to obtain the value of the random number from a look-up table in the microprocessor for use in determining the selected transmission time interval until the next transmission of a data packet.

11. The method according to claim 1 including:

storing the variable number in the microprocessor;

and using the sum of the changed value of the variable number after each transmission and the three least significant bits of the sensed value of the at least one condition at the predetermined location at the predetermined time relative to each transmission to obtain the value of the random number from a look-up table in the microprocessor for use in determining the selected transmission time interval until the next transmission of a data packet.

12. The method according to claim 1 including:

manually activating the microprocessor by closing a manually movable switch;

and utilizing the time that the manually movable switch is closed to determine whether the microprocessor causes activation of the transmitter irrespective of whether the selected transmission time interval has elapsed or causes inactivation of the microprocessor for the longest available period of time when the manually movable switch remains closed for a predetermined period of time without the microprocessor activating the transmitter.

13. The method according to claim 1 including changing the value of the at least one condition at the predetermined location to be transmitted each time that its value changes a predetermined amount between transmissions.

14. The method according to claim 1 including:

sensing the value of the at least one condition at the predetermined location after each transmission is completed and the microprocessor is inactivated;

and saving the sensed value for use as the sensed value of the at least one condition at the predetermined location in the data packet during the next transmission.

15. A method of randomly transmitting data packets to at least one wireless receiver from each of a plurality of wireless transmitters with each of the transmitters controlled by a separate microprocessor powered by a separate battery including:

sensing a value of at least one condition at a different predetermined location for each of the transmitters;

transmitting a data packet having the value of the at least one condition at each of the different predetermined locations at varying selected transmission time intervals by a different one of the transmitters with only one data packet transmitted during each selected transmission time interval for each of the transmitters, each of the transmitters transmitting independently of all of the other transmitters;

using the value of a stored variable number for each of the microprocessors independently of all of the other microprocessors and at least a portion of the value of the at least one condition at each of the different predetermined locations at a predetermined time relative to each transmission corresponding to a specific microprocessor to provide a random number value for use in determining the selected transmission time interval from the last transmission by the transmitter controlled by its specific microprocessor until a data packet having the value of the at least one condition at one of the different predetermined locations for the specific microprocessor is next to be transmitted by the transmitter controlled by its specific microprocessor;

changing the value of the stored variable number for each of the different microprocessors after each transmission by the transmitter controlled by its specific microprocessor;

using the changed value of the stored variable number in each specific microprocessor and at least a portion of the value of the at least one condition at each of the different predetermined locations at the predetermined time relative to each transmission corresponding to a specific microprocessor to change the random number value after each transmission of a data packet by the transmitter controlled by its specific microprocessor;

and using the changed random number value in determining the selected transmission time interval until the next transmission of a data packet by the transmitter controlled by its specific microprocessor.

16. The method according to claim 15 including:

automatically activating each of the microprocessors separately at a predetermined fixed time interval that is not necessarily the same for each of the microprocessors;

and automatically inactivating each of the microprocessors separately a predetermined time period after each activation unless the selected transmission time interval for the next transmission from the last transmission by the transmitter powered by the specific microprocessor has elapsed.

17. The method according to claim 16 including providing the data packets transmitted by each of the transmitters with a different identification number than the data packets transmitted by all of the other transmitters.

18. The method according to claim 17 including using a separate timing device for each of the microprocessors with each of the timing devices being external of its specific microprocessor for automatically activating the specific microprocessor independently of all of the other microprocessors at each of its predetermined fixed time intervals.

19. The method according to claim 18 including manually selectively activating any of the microprocessors independently of all of the other microprocessors.

20. The method according to claim 19 including:

storing the variable number for each of the microprocessors in the specific microprocessor independently of all of the other microprocessors;

and using the sum of the changed value of the variable number stored in the specific microprocessor after each transmission by the transmitter controlled by its specific microprocessor and at least a portion of the sensed value of the at least one condition at the specific different predetermined location at the predetermined time relative to each transmission by the transmitter controlled by its specific microprocessor to obtain the value of the random number from a look-up table in the specific controlling microprocessor for use in determining the selected transmission time interval until the next transmission of a data packet by the transmitter controlled by its specific microprocessor.

21. The method according to claim 20 including changing the value of the at least one condition at any of the different predetermined locations independently of all of the other different predetermined locations when its value changes a predetermined amount for transmission of the changed value the next time that its transmitter transmits.

22. The method according to claim 19 including:

storing the variable number for each of the microprocessors in the specific microprocessor independently of all of the other microprocessors;

and using the sum of the changed value of the variable number stored in the specific microprocessor after each transmission by the transmitter controlled by its specific microprocessor and the three least significant bits of the sensed value of the at least one condition at the specific different predetermined location at the predetermined time relative to each transmission by the transmitter controlled by its specific microprocessor to obtain the value of the random number from a look-up table in the specific controlling microprocessor for use in determining the selected transmission time interval until the next transmission of a data packet by the transmitter controlled by its specific microprocessor.

23. The method according to claim 19 including:

manually activating each of the microprocessors independently of all of the other microprocessors by closing a manually movable switch for the specific microprocessor;

and utilizing the time that the manually movable switch is closed to determine whether the activated microprocessor causes activation of the transmitter controlled by the activated microprocessor irrespective of whether the selected transmission time interval has elapsed or inactivates the activated microprocessor for the longest available period of time when the manually movable switch remains closed for a predetermined period of time without the activated microprocessor activating the transmitter it controls.

24. The method according to claim 16 including:

storing the variable number for each of the microprocessors in the specific microprocessor independently of all of the other microprocessors;

and using the sum of the changed value of the variable number stored in the specific microprocessor after each transmission by the transmitter controlled by its specific microprocessor and at least a portion of the sensed value of the at least one condition at the specific different predetermined location at the predetermined time relative to each transmission by the transmitter controlled by its specific microprocessor to obtain the value of the random number from a look-up table in the specific controlling microprocessor for use in determining the selected transmission time interval until the next transmission of a data packet by the transmitter controlled by its specific microprocessor.

25. The method according to claim 16 including:

storing the variable number for each of the microprocessors in the specific microprocessor independently of all of the other microprocessors;

and using the sum of the changed value of the variable number stored in the specific microprocessor after each transmission by the transmitter controlled by its specific microprocessor and the three least significant bits of the sensed value of the at least one condition at the specific different predetermined location at the predetermined time relative to each transmission by the transmitter controlled by its specific microprocessor to obtain the value of the random number from a look-up table in the specific controlling microprocessor for use in determining the selected transmission time interval until the next transmission of a data packet by the transmitter controlled by its specific microprocessor.

26. The method according to claim 15 including:

manually selectively activating any of the microprocessors independently of all of the other transmitter by closing a manually movable switch;

and utilizing the time that the manually movable switch is closed to determine whether the activated microprocessor is inactivated for the longest available period of time when the manually movable switch remains closed for a predetermined period of time or the activated microprocessor causes activation of the transmitter controlled by the activated microprocessor irrespective of whether the selected transmission time interval has elapsed when the manually movable switch is opened prior to the predetermined period of time elapsing.

27. The method according to claim 15 including changing the value of the at least one condition at any of the different predetermined locations independently of all of the other different predetermined locations when its value changes a predetermined amount for transmission of the changed value the next time that its transmitter transmits.

28. A communication system including:

a wireless transmitter for transmitting data packets to at least one wireless receiver;

a microprocessor controlling said transmitter;

a battery for powering said microprocessor;

a sensor for sensing a value of at least one condition at a predetermined location;

said microprocessor using the value of a stored variable number and at least a portion of the value of the at least one condition at the predetermined location at a predetermined time relative to each transmission for providing a random number value for use in determining a selected transmission time interval from the last transmission until the next transmission by said transmitter of a data packet having the value of the at least one condition at the predetermined location;

and said microprocessor having an algorithm for changing the random number value after each transmission of a data packet by said transmitter.

29. The communication system according to claim 28 including:

said microprocessor having a memory;

said memory of said microprocessor storing the variable number having its value changed in response to each transmission of a data packet by said transmitter;

said memory of said microprocessor storing the sensed value of the at least one condition at the predetermined location;

said microprocessor having a look-up table with a plurality of random numbers and one of the plurality of random number values corresponding to the value of each of the sums of the value of the variable number and at least a portion of the value of the at least one condition at the predetermined location after the last transmission;

said microprocessor utilizing the sum of the value of the variable number and at least a portion of the value of the at least one condition at the predetermined location stored in said memory after the last transmission to obtain the random number value from the look-up table for use in determining the selected transmission time interval until the next transmission of the data packet from the last transmission;

and said microprocessor using the sum of the value of a base transmission time interval and a predetermined portion of the value of the number from the look-up table as the selected transmission time interval until the next transmission of the data packet.

30. The communication system according to claim 29 in which:

said sensor senses the value of the at least one condition at the predetermined location after each transmission of the data packet by said transmitter is completed;

and said microprocessor is inactivated after completion of each transmission of the data packet by said transmitter and before said sensor senses the value of the at least one condition at the predetermined location after completion of each transmission of the data packet by said transmitter.

31. The communication system according to claim 30 in which:

said sensor includes a memory;

said sensor stores in said memory of said sensor the value of the at least one condition at the predetermined location sensed after completion of each transmission of the data packet by said transmitter and inactivation of said microprocessor;

and said sensor is inactivated upon completion of storing in said memory of said sensor the value of the at least one condition at the predetermined location sensed after each transmission of the data packet by said transmitter and after said microprocessor is inactivated.

32. The communication system according to claim 31 in which the algorithm for changing the random number value after each transmission of a data packet by said transmitter is software.

33. The communication system according to claim 32 including a timing device for automatically activating said microprocessor at a predetermined fixed time interval.

34. The communication system according to claim 33 in which said timing device is external of said microprocessor.

35. The communication system according to claim 29 including:

a manually movable switch for selectively activating said microprocessor when said manually movable switch is closed;

and said microprocessor having an algorithm for inactivating said microprocessor after a predetermined period of time has elapsed from manual closing of said manually movable switch or for activating said transmitter to transmit a data packet when said manually movable switch is opened prior to elapsing of the predetermined period of time.

36. The communication system according to claim 35 in which the algorithm is software to inactivate said microprocessor after said microprocessor is activated when said switch is manually closed for the predetermined period of time or to activate said transmitter to transmit a data packet when said manually movable switch is opened prior to elapsing of the predetermined period of time.

37. The communication system according to claim 36 in which:

said sensor senses the value of the at least one condition at the predetermined location after completion of each transmission of the data packet by said transmitter;

and said microprocessor is automatically inactivated after completion of each transmission of the data packet by said transmitter and before said sensor senses the value of the at least one condition at the predetermined location after completion of each transmission of the data packet by said transmitter.

38. The communication system according to claim 29 in which:

said sensor senses the value of the at least one condition at the predetermined location after completion of each transmission of the data packet by said transmitter;

and said microprocessor has an algorithm to inactivate said microprocessor after completion of each transmission of the data packet by said transmitter and before said sensor senses the value of the at least one condition at the predetermined location after completion of each transmission of the data packet by said transmitter.

39. The communication system according to claim 29 in which the algorithm for changing the random number value after each transmission of a data packet by said transmitter is software.

40. The communication system according to claim 28 including:

a manually movable switch for selectively activating said microprocessor when said manually movable switch is closed;

and said microprocessor having an algorithm for inactivating said microprocessor after a predetermined period of time has elapsed from manual closing of said manually movable switch or for activating said transmitter to transmit a data packet when said manually movable switch is opened prior to elapsing of the predetermined period of time.

41. The communication system according to claim 40 in which the algorithm is software to inactivate said microprocessor after said microprocessor is activated when said switch is manually closed for the predetermined period of time or to activate said transmitter to transmit a data packet when said manually movable switch is opened prior to elapsing of the predetermined period of time.

42. The communication system according to claim 41 in which:

said sensor senses the value of the at least one condition at the predetermined location after completion of each transmission of the data packet by said transmitter;

and said microprocessor is automatically inactivated after completion of each transmission of the data packet by said transmitter and before said sensor senses the value of the at least one condition at the predetermined location after completion of each transmission of the data packet by said transmitter.

43. The communication system according to claim 42 in which: said sensor includes a memory;

said sensor stores in said memory of said sensor the value of the at least one condition at the predetermined location sensed after completion of each transmission of the data packet by said transmitter and automatic inactivation of said microprocessor;

and said sensor is inactivated upon completion of storing the value of the at least one condition at the predetermined location sensed after each transmission of the data packet by said transmitter is completed and after said microprocessor is automatically inactivated.

44. The communication system according to claim 28 including:

said microprocessor having a memory;

said memory of said microprocessor storing the variable number having its value changed in response to each transmission of a data packet by said transmitter;

said memory of said microprocessor storing the sensed value of the at least one condition at the predetermined location;

said microprocessor having a look-up table with a plurality of random numbers and one of the plurality of random number values corresponding to the value of each of the sums of the value of the variable number and the three least significant bits of the value of the at least one condition at the predetermined location after the last transmission;

said microprocessor utilizing the sum of the value of the variable number and the value of the three least significant bits of the at least one condition at the predetermined location after the last transmission to obtain the random number value from the look-up table for use in determining the selected transmission time interval until the next transmission of the data packet;

and said microprocessor using the sum of the value of a base transmission time interval and the three least significant bits of the value of the number from the look-up table as the selected transmission time interval until the next transmission of the data packet.

45. The communication system according to claim 28 in which the algorithm for changing the random number value after each transmission of a data packet by said transmitter is software.

46. The communication system according to claim 28 in which said microprocessor includes:

first using means for using a stored variable number value and at least a portion of the value of the at least one condition at the predetermined location at a predetermined time relative to each transmission to provide a random number value for use in determining the selected transmission time interval from the last transmission until a data packet having the value of the at least one condition at the predetermined location is next to be transmitted by said transmitter;

changing means for changing the value of the stored variable number after each transmission of a data packet by said transmitter;

second using means for using the changed value of the stored. variable number and at least a portion of the value of the at least one condition at the predetermined location at the predetermined time relative to each transmission to change the random number value after each transmission of a data packet by said transmitter;

and third using means for using the changed random number value in determining the selected transmission time interval until the next transmission of a data packet by said transmitter.

* * * * *

UNITED STATES PATENT AND TRADEMARK OFFICE

CERTIFICATE OF CORRECTION

PATENT NO. : 6,721,546 B1
DATED : April 13, 2004
INVENTOR(S) : John I. Compton

It is certified that error appears in the above-identified patent and that said Letters Patent is hereby corrected as shown below:

Column 6,
Line 21, “depressed” should read -- depressed, --

Column 18,
Lines 32-33, should read
-- 43. The communication system according to claim 42 in which:
said sensor includes a memory; --

Column 20,
Line 7, “stored. variable” should read -- stored variable --

Signed and Sealed this

Third Day of August, 2004

JON W. DUDAS
*Acting Director of the United States Patent and Trademark Office*